US006695403B1

(12) United States Patent
Su

(10) Patent No.: US 6,695,403 B1
(45) Date of Patent: Feb. 24, 2004

(54) BACKREST SUPPORTING ASSEMBLY

(76) Inventor: Tung-Hua Su, No. 6, Sec. 3, Bao Ta Road, Kuwi Jen Hsiang, Tainan Hsien (TW)

( * ) Notice: Subject to any disclaimer, the term of this patent is extended or adjusted under 35 U.S.C. 154(b) by 0 days.

(21) Appl. No.: 10/318,535

(22) Filed: Dec. 14, 2002

(51) Int. Cl.[7] ..... A47C 3/025

(52) U.S. Cl. ..... 297/284.7; 297/450.1; 297/451.1

(58) Field of Search ..... 297/284.7, 284.4, 297/450.1, 451.1, 463.1

(56) References Cited

U.S. PATENT DOCUMENTS 2,832,397 A * 4/1958 Premo ..... 297/440.15
3,947,068 A * 3/1976 Buhk ..... 297/450.1
6,471,294 B1 * 10/2002 Dammermann et al. . 297/284.7
6,572,190 B2 * 6/2003 Koepke et al.

* cited by examiner

*Primary Examiner*—Laurie K. Cranmer
(74) *Attorney, Agent, or Firm*—Charles E. Baxley

(57) ABSTRACT

A chair includes a seat, a backrest mounted to the seat, the backrest including a rear face having two sides, a chassis fixed to an underside of the seat, a leg assembly attached to the chassis, two stays respectively attached to the sides of the rear face of the backrest, and a connecting frame. Each stay has an upper end fixed to an associated side of the rear face of the backrest. The connecting frame has two ends and an extension extending from the connecting frame. The extension is securely connected to a rear end of the chassis. Each end of the connecting frame is fixed to a lower end of an associated stay.

2 Claims, 6 Drawing Sheets

BACKREST SUPPORTING ASSEMBLY

BACKGROUND OF THE INVENTION

1. Field of the Invention

The present invention relates to a backrest supporting assembly that provides improved supporting stability and improved seating safety.

2. Description of the Related Art

FIGS. 5 and 6 of the drawings illustrate a conventional chair including a backrest 1', a seat 2', a chassis 3', a leg assembly 4', and a substantially L-shaped connecting plate 5'. The backrest 1' includes a connecting portion 11' in an intermediate portion of a lower end of a rear face thereof, the connecting portion 11' having fixing holes 12' for connection with an arm of the L-shaped connecting plate 5' that has fixing holes 51'. The chassis 3' is fixed to an underside of the seat 2' and has a lower end for connection with the leg assembly 4'. Further, the chassis 3' includes a connecting portion 31' at a rear end thereof, the connecting portion 31' having fixing holes 32' for connection with the other arm of the L-shaped connecting plate 5' that has fixing holes 52'.

In use, a person sitting in the seat 2' and lying his or her back on the backrest 1' imparts a load to the backrest 1' which is supported by the connecting plate 5'. The supporting point is located in a central position of the lower portion of the backrest 1'. Two sides of the backrest 1' are subject to unequal forces if the center of gravity of the person is offset from the central vertical axis of the backrest 1'. Thus, the connecting plate 5' could not provide reliable support to the backrest 1'.

SUMMARY OF THE INVENTION

An object of the present invention is to provide backrest supporting assembly that provides improved supporting stability and improved seating safety.

A chair in accordance with the present invention comprises a seat, a backrest mounted to the seat, the backrest including a rear face having two sides, a chassis fixed to an underside of the seat, a leg assembly attached to the chassis, two stays respectively attached to the sides of the rear face of the backrest, and a connecting frame. Each stay has an upper end fixed to an associated side of the rear face of the backrest. The connecting frame has two ends and an extension extending from the connecting frame. The extension is securely connected to a rear end of the chassis. Each end of the connecting frame is fixed to a lower end of an associated stay.

Two connecting plates are respectively fixed to the sides of the rear face of the backrest. Each connecting plate is securely connected to the upper end of an associated stay. A waist is securely connected between the connecting plates.

Each connecting plate includes a guide slot. The waist includes two ends each having a peg with a fixing hole, the peg being extended through the guide slot. A pressing block is attached to each peg and has a fixing hole in a first end thereof and an engaging groove in a second end thereof, the engaging groove of the pressing block being aligned with the fixing hole of the pressing block. Each peg is received in the engaging groove of an associated pressing block, with a fastener being extended through the fixing hole of the pressing block and the fixing hole of the peg.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
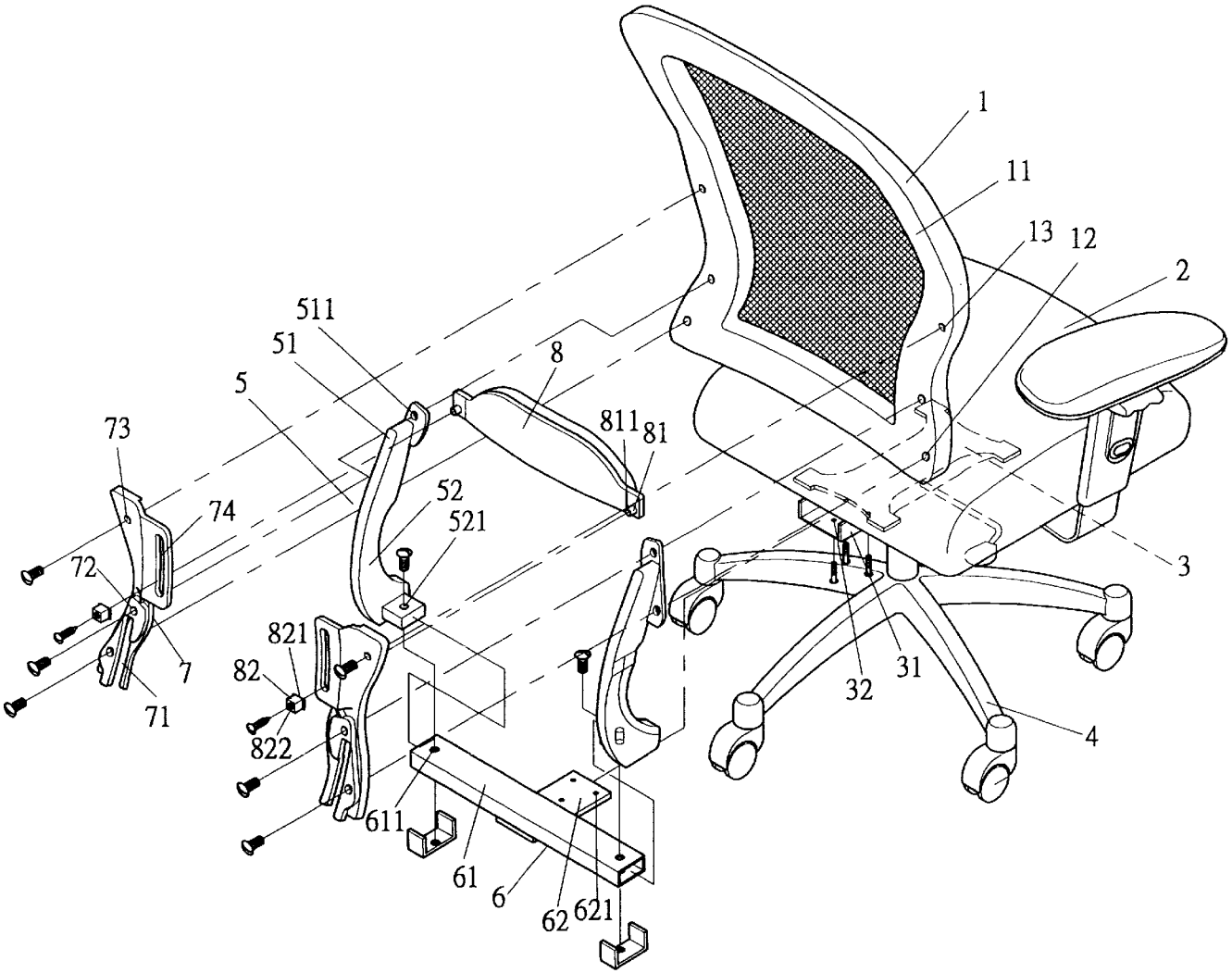
FIG. 1 is an exploded perspective view of a chair in accordance with the present invention.
Figure 2:
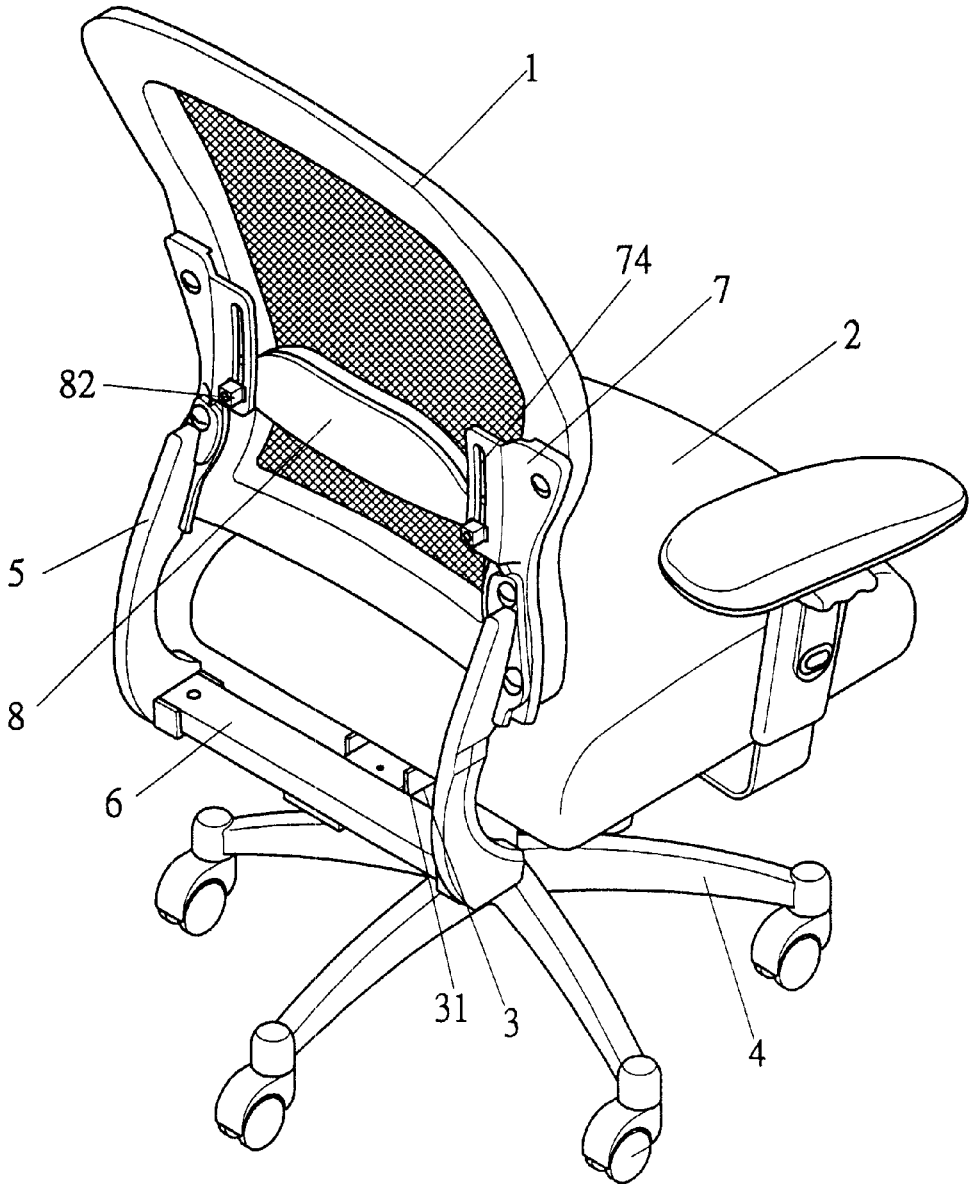
FIG. 2 is a perspective view of the chair in accordance with the present invention.
Figure 3:
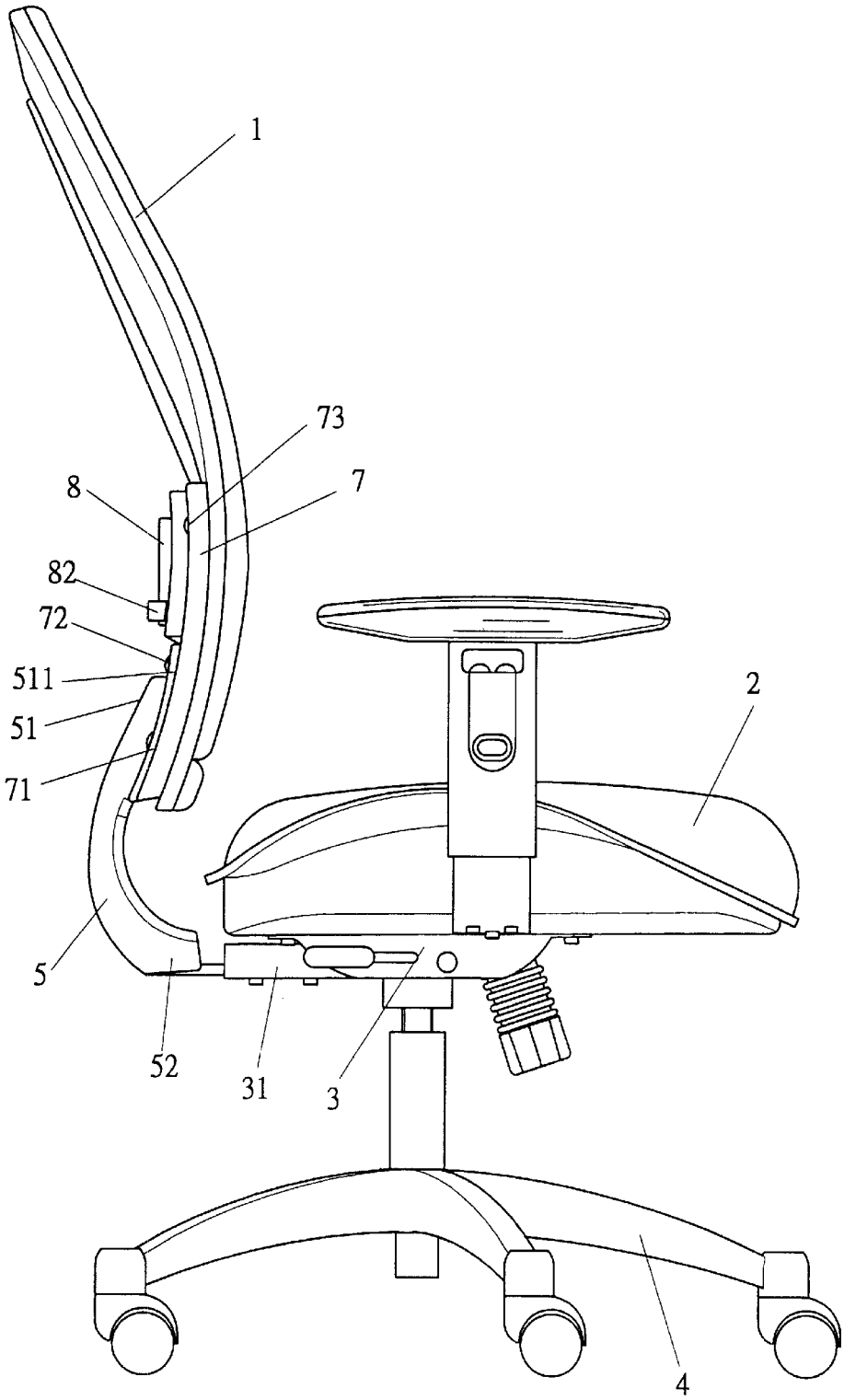
FIG. 3 is a side view of the chair in accordance with the present invention.

Referring to FIGS. 1 through 3, a chair in accordance with the present invention generally comprises a backrest 1, a seat 2, a chassis 3, a leg assembly 4, two stays 5, a connecting frame 6, two connecting plates 7, and a waist support 8.

The backrest 1 includes a connecting portion 11 on each of two sides of a rear face thereof, the connecting portion 11 having fixing holes 13 for connection with the stays 5 and the connecting plates 7. The chassis 3 is fixed to an underside of the seat 2 and includes a connecting portion 31 on a rear end thereof, the connecting portion 31 having fixing holes 32 for connection with the connecting frame 6.

Each stay 5 is a substantially L-shaped member and includes a connecting portion 51, 52 on each of two ends thereof, wherein the connecting portion 52 on the lower end has a fixing hole 521 for connection with two ends of the connecting frame 6, and wherein the connecting portion 51 on the upper end has a fixing hole 511 for connection with the backrest 1.

The connecting frame 6 includes a connecting portion 61 on each of two ends thereof, the connecting portion 61 having a fixing hole 611 for connection with the lower end of an associated stay 52. Further, the connecting frame 6 includes an extension 62 extending from an intermediate portion thereof, the extension 62 having fixing holes 621 for connection with the rear end of the chassis 3.

Each connecting plate 7 includes a fixing hole 72 in a lower end thereof for connection with the upper end of an associated stay 5. The lower end of each connecting plate 7 further includes an engaging slot 71. An upper end of each connecting plate 7 includes a fixing hole 73 for connection with the backrest 1 and a guide slot 74 for connection with the waist 8. The engaging slot 71 of each connecting plate 7 is engaged with the upper end of an associated stay 5, and fasteners (not labeled) are used to connect the connecting plate 7 with the associated stay 5 and the backrest 1. Further, the stays 5 are connected to the connecting frame 6 by fasteners (not labeled), and the extension 62 of the connecting frame 6 is connected to the chassis 3 by fasteners (not labeled).

The waist 8 is an elongated member having two ends. A peg 81 and a pressing block 82 are attached to each end of the waist 8. Each peg 81 is extended through the guide slot 74 of an associated connecting plate 7 and has a fixing hole 811. Each pressing block 82 is elastomeric and includes an engaging groove 821 in a first end thereof and a fixing hole 822 in a second end thereof for connection with an associated peg 81, the fixing hole 822 being aligned with the engaging groove 821.

Figure 4:
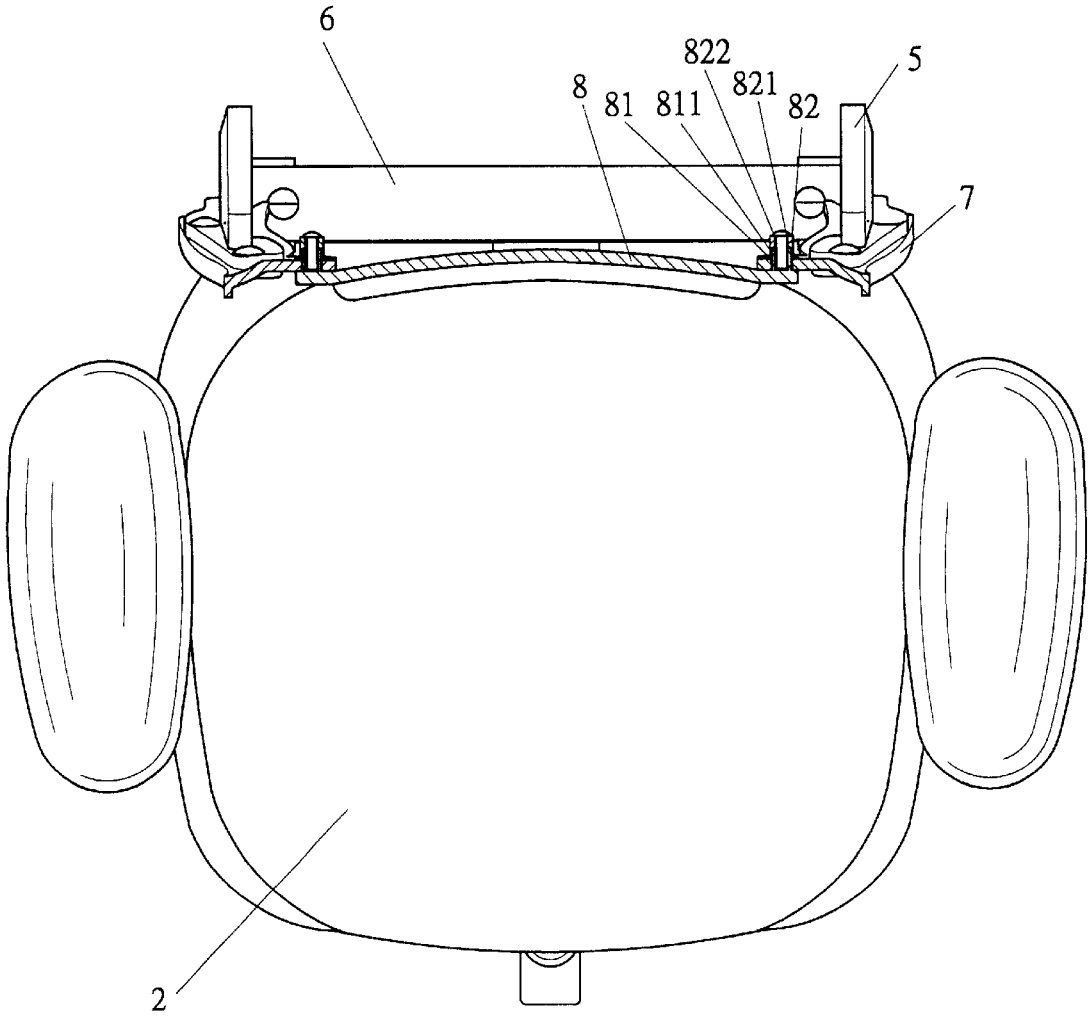
FIG. 4 is a top view, partly sectioned, of the chair in accordance with the present invention.
Figure 5:
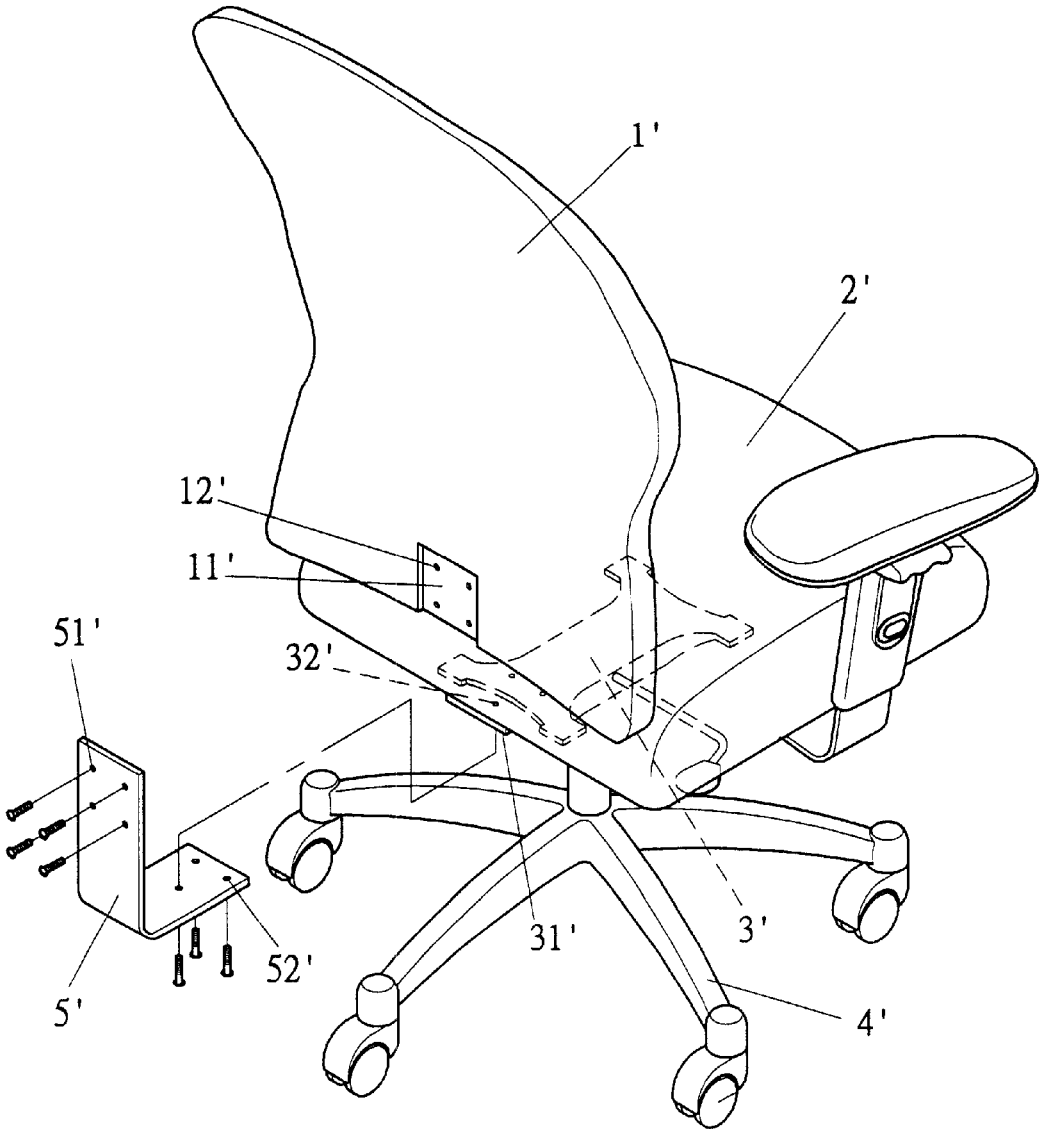
F I G . 5(PRIOR ART)
FIG. 5 is a perspective view, partly exploded, of a conventional chair.
Figure 6:
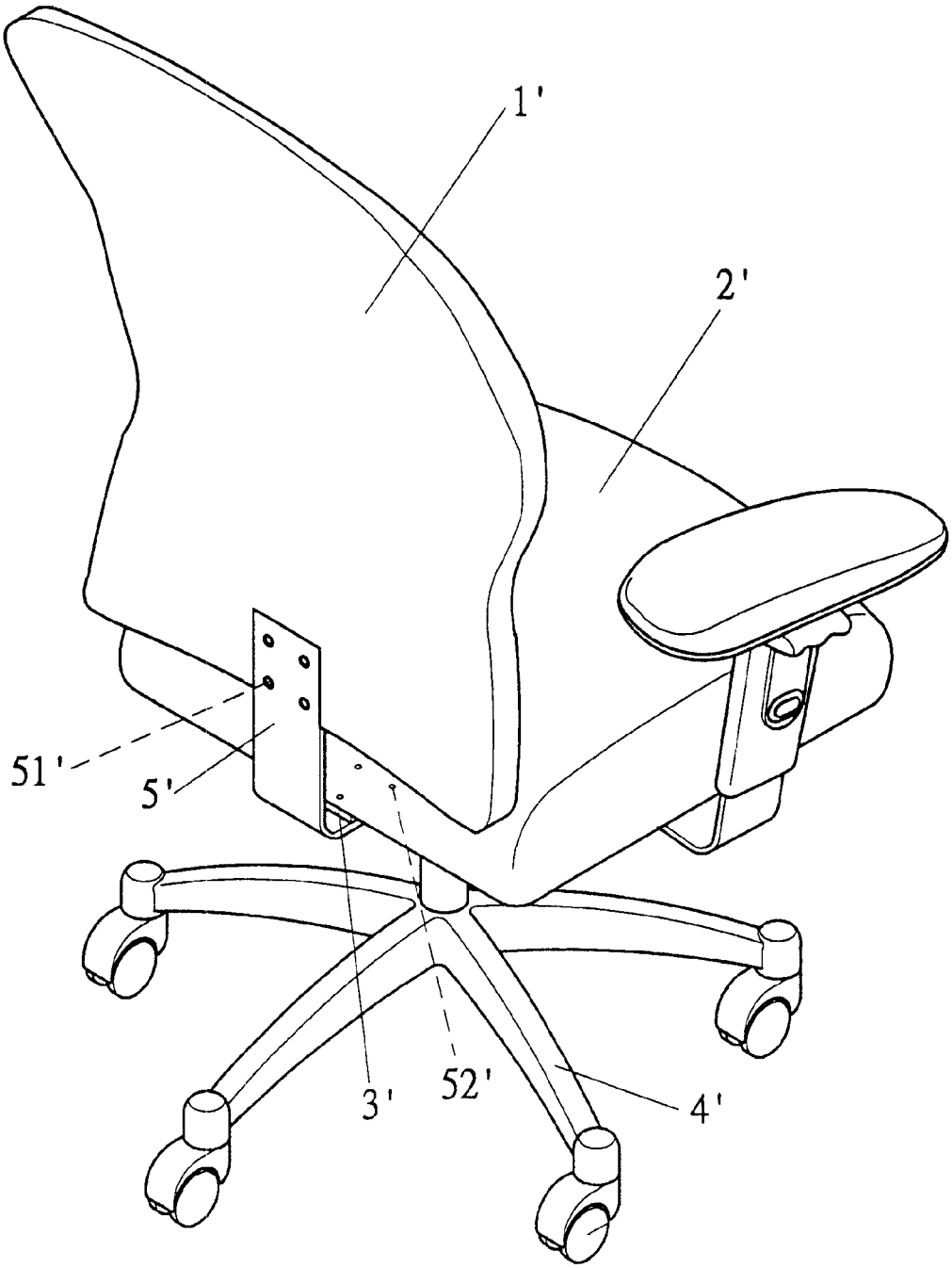
F I G . 6(PRIOR ART)
FIG. 6 is a perspective view of the conventional chair in FIG. 5.

Referring to FIG. 4, in assembly, each peg 81 of the waist 8 is extended through the guide slot 74 of an associated connecting plate 7. The engaging groove 821 of each pressing block 82 receives an associated peg 81. A fastener (not shown) is then extended through the fixing hole 822 of the respective pressing block 82 and the fixing hole 811 of the respective peg 81. Thus, each pressing block 82 and its associated peg 81 are connected together with an appropriate tightness existed therebetween. The elastomeric the pressing blocks 82 press against the connecting plates 7 to thereby retain the waist 8 in a desired level. The position of the waist 8 can be adjusted by applying a force.

When a person sits in the seat 2 and lies on the backrest 1, the lying force imparted to the backrest 1 is supported by the stays 5 and the connecting frame 6. Further, the waist 8 is connected to the connecting plates 7, the stays 5, and the connecting frame 6, which increases the backrest's supporting stability and the sitting safety.

Although the invention has been explained in relation to its preferred embodiment, it is to be understood that many other possible modifications and variations can be made without departing from the scope of the invention as hereinafter claimed.

What is claimed is:

1. A chair comprising:

a seat;

a backrest mounted to the seat, the backrest including a rear face having two sides;

a chassis fixed to an underside of the seat, the chassis having a rear end;

a leg assembly attached to the chassis;

two stays respectively attached to the sides of the rear face of the backrest, each said stay having an upper end fixed to an associated one of the sides of the rear face of the backrest, each said stay further having a lower end; and a connecting frame having two ends and an extension extending from the connecting frame, the extension being securely connected to the rear end of the chassis, each said end of the connecting frame being fixed to the lower end of an associated one of the stays further comprising two connecting plates respectively fixed to the sides of the rear face of the backrest, each said connecting plate being securely connected to the upper end of an associated one of the stays, a waist being securely connected between the connecting plates.

2. The chair as claimed in claim 1, wherein each said connecting plate includes a guide slot, the waist including two ends each having a peg with a fixing hole, the peg being extended through the guide slot, a pressing block being attached to each said peg and having a fixing hole in a first end thereof and an engaging groove in a second end thereof, the engaging groove of the pressing block being aligned with the fixing hole of the pressing block, each said peg being received in the engaging groove of an associated one of the pressing blocks, with a fastener being extended through the fixing hole of the pressing block and the fixing hole of the peg.

* * * * *